US007900862B2

(12) United States Patent
Gingras

(10) Patent No.: US 7,900,862 B2
(45) Date of Patent: Mar. 8, 2011

(54) MECHANICAL PULPING REFINER PLATE HAVING CURVED REFINING BARS WITH JAGGED LEADING SIDEWALLS AND METHOD FOR DESIGNING PLATES

(75) Inventor: Luc Gingras, Lake Oswego, OR (US)

(73) Assignee: Andritz Inc., Glens Falls, NY (US)

( * ) Notice: Subject to any disclaimer, the term of this patent is extended or adjusted under 35 U.S.C. 154(b) by 228 days.

(21) Appl. No.: 12/028,175

(22) Filed: Feb. 8, 2008

(65) Prior Publication Data

US 2008/0191078 A1 Aug. 14, 2008

Related U.S. Application Data

(60) Provisional application No. 60/888,817, filed on Feb. 8, 2007.

(51) Int. Cl.
*B02C 7/12* (2006.01)

(52) U.S. Cl. ..... 241/298

(58) Field of Classification Search ..... 241/261.2, 241/261.3, 298, 260
See application file for complete search history.

(56) References Cited

U.S. PATENT DOCUMENTS

| | | | | |
|---|---|---|---|---|
| 804,738 | A * | 11/1905 | Kreps | 241/298 |
| 827,059 | A * | 7/1906 | Davis | 241/298 |
| 1,609,717 | A * | 12/1926 | Holland-Letz | 241/261.3 |
| 4,023,737 | A | 5/1977 | Leider et al. | |
| 4,712,745 | A | 12/1987 | Leith | |
| 5,165,592 | A | 11/1992 | Wasikowski | |
| 5,362,003 | A * | 11/1994 | Virving | 241/261.3 |
| 5,425,508 | A | 6/1995 | Chaney | |
| 5,467,931 | A | 11/1995 | Dodd | |
| 5,683,048 | A * | 11/1997 | Virving | 241/261.2 |
| 5,690,286 | A | 11/1997 | Dodd et al. | |
| 5,695,136 | A * | 12/1997 | Rohden et al. | 241/261.3 |
| 6,276,622 | B1 * | 8/2001 | Obitz | 241/261.3 |
| 6,592,062 | B1 * | 7/2003 | Virving | 241/261.3 |
| 7,419,112 | B2 * | 9/2008 | Sjostrom et al. | 241/298 |

FOREIGN PATENT DOCUMENTS

| | | |
|---|---|---|
| FI | 53469 | 1/1978 |
| SE | 513 807 | 11/2000 |
| WO | 00/56459 | 9/2000 |

OTHER PUBLICATIONS

International Search Report mailed May 28, 2008.

* cited by examiner

*Primary Examiner* — Faye Francis
(74) *Attorney, Agent, or Firm* — Nixon & Vanderhye P.C.

(57) ABSTRACT

A refiner plate for a mechanical refiner of lignocellulosic material including: a refining surface on a substrate, wherein the refining surface is adapted to face a refining surface of an opposing refiner plate; wherein the refining surface includes bars and grooves between the bars and the bars have at least a radially outer section in which the bars include a leading sidewall having an irregular surface in the outer section.

18 Claims, 12 Drawing Sheets

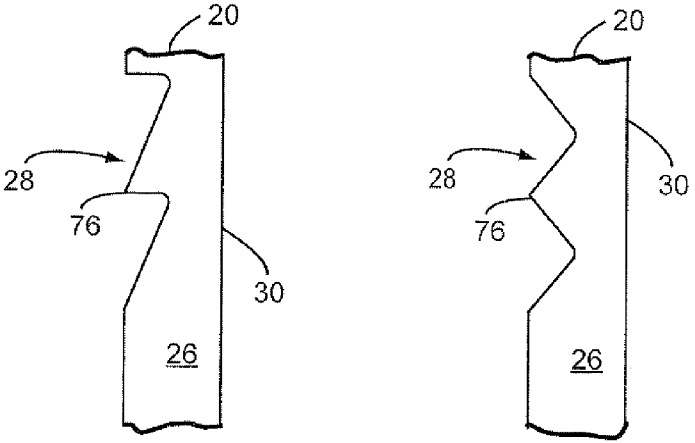
FIG. 13
FIG. 14
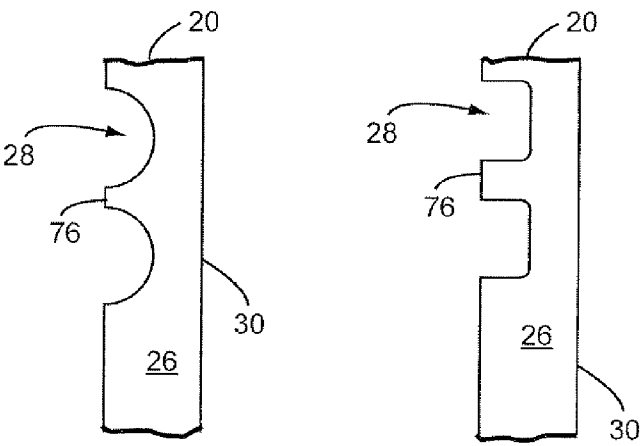
FIG. 15
FIG. 16
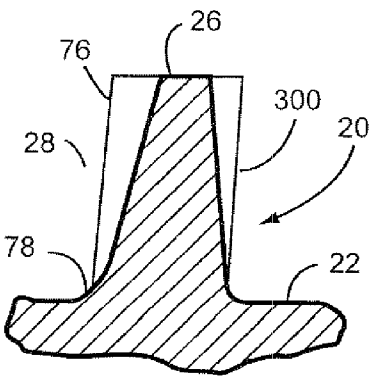
FIG. 17
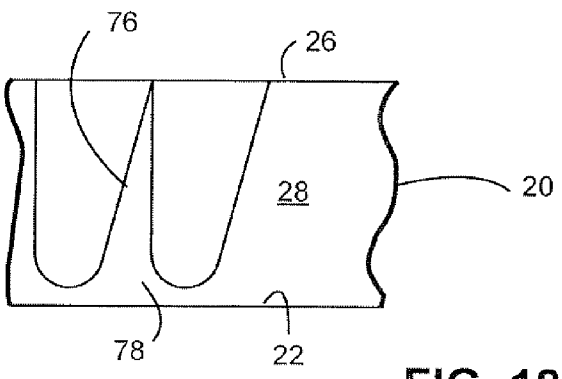
FIG. 18

MECHANICAL PULPING REFINER PLATE HAVING CURVED REFINING BARS WITH JAGGED LEADING SIDEWALLS AND METHOD FOR DESIGNING PLATES

CROSS-RELATED APPLICATION

This application claims the benefit of U.S. Provisional Application Ser. No. 60/888,817, filed Feb. 8, 2007, the entirety of which is incorporated by reference.

BACKGROUND OF THE INVENTION

This invention relates to disc refiners for lignocellulosic materials (referred to as "fibrous material"), and more specifically to disc refiners used for producing mechanical pulp, thermomechanical pulp and a variety of chemi-thermomechanical pulps (collectively referred to as mechanical pulps and mechanical pulping process).

In the mechanical pulping process, raw fibrous material, typically wood or other lignocellulosic material, is fed through the middle of one of a refiners discs and propelled outwards by a strong centrifugal force created by the rotation of one or both discs. The disc(s) typically operate at rotational speeds of 1200 to 2300 revolutions per minute (RPM). While the fibrous material is retained between the discs, energy is transferred to the fibrous material from refiner plates attached to the discs. The energy transferred to the fibrous material separates individual fibers in the fibrous material from a network of fibers in the material. The separation of individual fibers constitutes refining of the fibrous material into a pulp product that may be used to form paper, fiberboard and other fiber based products.

The refiner plates each have surfaces with patterns of bars and grooves. The surfaces are opposite to each other when a pair of refiner plates are mounted in a refiner. The bars and grooves on the opposing refiner plate surfaces generate repeated compression forces that act on the fibrous material flowing between the plates. The compression action against the fibrous material results in the separation of lignocellulosic fibers from the feed material and provides a certain amount of development or fibrillation of the fibrous material. The fiber separation and development is necessary to transform the raw fibrous material to a suitable pulp for fiber board, paper or other fiber based products. The refining action imparted by the bars and grooves may also generate some cutting of the fibers, which is usually a less desirable result of the mechanical pulping process.

In the mechanical pulping refining process, a large amount of friction occurs that reduces the energy efficiency of the refining process. It has been calculated that the refining efficiency of the energy applied in mechanical pulping is in the order of 5 percent (%) to 15%.

Efforts to develop refiner plates which work at higher energy efficiencies typically involve reducing the operating gap between opposing discs. Conventional techniques for lowering energy consumption in mechanical refiners typically rely on design features of refining patterns on the front face of refiner plate that speed up the feed of material across the refining zone. These techniques often result in reducing the thickness of the fibrous pad in the gap between the opposing plates. When energy is applied to a thinner fiber pad, the compression rate becomes greater for a given energy input and results in a more efficient energy input.

A drawback to reducing the thickness of the fiber pad are that the operating gaps between the refiner plate bars is reduced. Reducing the gap between the opposing refiner plate bars often results in an increase in fiber cutting, a loss in pulp strength properties due to the cut fibers, and a reduction in the operating life of the refiner plates due to the excessive wear of plates. A narrow gap, e.g., clearance between bars on opposing plates, may achieve a higher compression ratio and higher efficiency but suffers a reduced operational life. There is a link between operating refining gap and refiner plate lifetime, the latter being exponentially reduced with reducing gap. Reducing the operating refining gaps results in an increase in the wear rate of the refiner plates and shorter plate life.

There is a long felt need for refiner plates that provide high energy efficiencies in transferring the mechanical energy from the rotation of the plates into the fibrous feed material, having relatively long operational plate lives and that minimize the cutting of fibers in the feed material.

BRIEF DESCRIPTION OF THE INVENTION

A novel refiner plate has been developed to improve energy efficiency, while maintaining a large operating gap between refiner plates on opposing discs. Advantages of the refiner include high energy efficiency, maintaining high fiber quality, and long operating life of the plates.

In one embodiment, the refiner plate is an assembly of rotor plate segments having an outer refining zone with refining bars that have at least a radially outward refining section with a curved longitudinal shape to form large holdback angle at the outer plate periphery of at least thirty (30) degrees and preferably angles of 45, 60 and 70 degrees. The leading sidewalls of the refining bars have surfaces that are serrated, jagged or otherwise irregular. The bars with irregular surfaces on the sidewalls and large holdback angles increase the retention time of feed material in the outer refining zone and thereby increase the refining of the fibrous material by the outer zone.

A refining plate has been developed with a refining surface to face the refining surface of an opposing plate in a mechanical refiner. The refining surface includes a plurality of bars upstanding from the substrate of the plate. The bars extend radially outwardly towards an outer periphery of the plate, and have a serrated, jagged or other irregular surfaces on the leading sidewall (face) of the bars. The bars may be straight or curved, such as with an exponential or in an involute arc. The bars form an aggressive holdback angle at the outer radial regions of the bars. The refining plate may be a rotor plate and arranged in a refiner opposite to a stator plate or another rotor plate.

A refiner plate has been developed for a mechanical refiner of lignocellulosic material comprising: a refining surface on a substrate, wherein the refining surface is adapted to face a refining surface of an opposing refiner plate, and the refining surface includes bars and grooves between the bars, wherein the bars have at least a radially outer section and the bars each include a leading sidewall having an irregular surface in the outer section.

A refiner plate has been developed for a mechanical refiner of lignocellulosic materials, the plate having a refining surface comprising: a plurality of bars upstanding from a substrate of the surface, wherein the bars extend outwardly towards an outer periphery of the plate, and the bars include an irregular leading sidewall on at least a portion of the bars.

A method has been developed for mechanically refining lignocellulosic material in a refiner having opposing refiner plates, the method comprising: introducing the material to an inlet in one of the opposing refiner plates or array of plate segments; rotating at least one of the plates with respect to the other plate, wherein the material moves radially outward through a gap between the plates due to centrifugal forces created by the rotation; as the material moves through the gap, passing the material over bars in a refining section of a first one the plates and through grooves between the bars, wherein the bars have at least a radially outer section in which the bars include a leading sidewall having an irregular surface in the outer sections; inhibiting the movement of the fibrous material through the a groove by the interaction of the fibrous material and the irregular surface on the leading sidewall of the bar adjacent the groove, and discharging the material from the gap at a periphery of the refiner plates.

BRIEF DESCRIPTION OF THE DRAWINGS

FIGS. 13 to 16 each show a top down view of an example of an irregular surface on a leading sidewall of a bar in the outer refining zone on a refiner plate segment.

FIG. 17 is a cross sectional diagram of a refining bar having an irregular surface on the leading and trailing sidewalls of the bar.

FIG. 18 is a front view of the leading sidewall of the bar shown in FIG. 17.

DETAILED DESCRIPTION OF THE INVENTION

Figure 2:
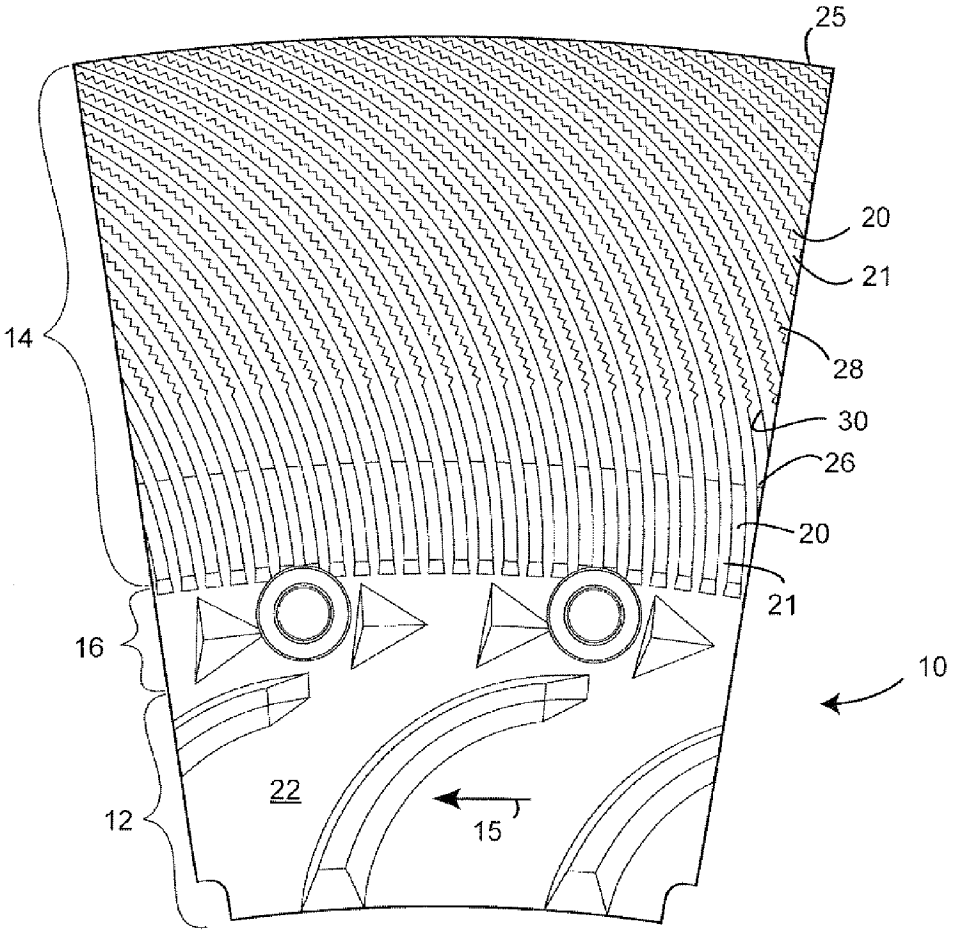
FIG. 2 is a front view of the refiner plate segment shown in FIG. 1 and shows refining bars with jagged leading sidewalls shaped in a saw-tooth pattern.

The mechanical refining process applies cyclical compressions to a fibrous pad of fibrous material moving between opposing refining plates. The compressions result from the rotation of one plate relative to the other and, particularly, to the crossing of bars in the opposing plates. The compressions cause fibers in the material to separate from a network fibers in the material. The plates are typically mounted on discs in a refiner, wherein at least one of the discs rotates one of the refiner plates. The energy efficiency of the refining process may be improved by increasing the compression ratio of the fibrous pad and increasing the period during which fibers in the pad are subjected to the compressions. The increased compression ratios are achieved with the refiner plate designs disclosed herein without necessarily reducing the gap between the plates or reducing the gap only to the extent now done in conventional high energy efficiency refiners.

A relatively wide gap, e.g., 1.0 mm (millimeters) to 2.0 mm, between the rotor and stator plates in a refiner (as compared to the gap in high energy efficiency refiner e.g., 0.3 mm to 0.7 mm) must be achieved through a thicker pulp pad formed between the plates. A high compression ratio is achieved with a thick pulp pad using a significantly coarser bar and groove pattern on a refiner plate as compared to the bar and groove patterns on conventional rotor plates used in similar high energy efficiency applications.

A coarse bar and groove pattern for a refining zone of a refiner plate has been developed having a lower density of bars as compared to the typical bar and groove patterns used in conventional high energy refiner plates. The fewer bars in a coarse pattern have fewer the compression cycles applied by the bars of the rotor as they pass across the bars on the stator, as compared to the compression cycles that occur with conventional plates having a higher density of bars. With respect to the coarse density of bars, the energy being transferred by the fewer compression cycles tends to increase the intensity of each compression cycle and increase the energy efficiency of each cycle to transfer energy from the plate to the fibrous material.

Refiner plates have been developed that have a relatively short, in a radial direction, effective refining surface, a coarse bar and groove pattern, aggressive holdback angles and other features to provide for a long retention of fibrous material in the effective refining zone of the plate. These features, which can be applied singularly or collectively, yield a higher energy concentration in the refining zone by reducing the cycle rate of bar crossings (resulting in fewer compression events during a plate rotation), and extending the retention time for the raw fibrous material in the refining zone. These features allow a larger operating gap between the plates and, thus, provide for high compression rates applied to a thick fiber mat between plates having a generous gap between them. In one embodiment, the high intensity of compression events may be achieved by lowering the number of bar crossing events and maximizing the amount of fiber present at each crossing.

The rotor refiner plate designs disclosed herein achieve high fiber retention and high compression to provide high energy efficiencies, while preserving fiber length and improving wear life of the refiner plates. Various stator plate designs used with the rotor plates disclosed herein may achieve the desired results of high compression ratio, enhanced energy efficiency, extended fiber retention between the plates, long fiber lengths.

Figure 1:
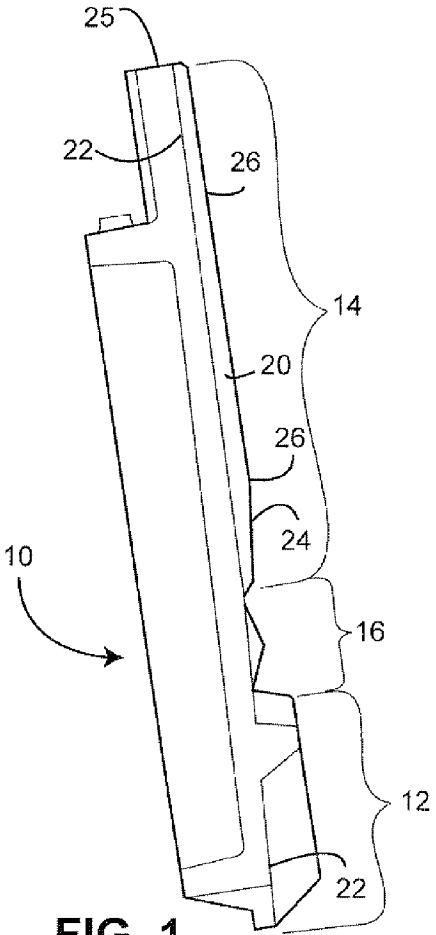
FIG. 1 is a side view of a rotor refiner plate segment.

FIGS. 1 and 2 shown a side view and a front view, respectively, of a rotor plate segment 10 having an inlet section 12 and an outer section 14. An array of plate segments is arranged in a annulus on a refiner disc to form a circular refining plate. The rotor plate is mounted on a rotatable disc and the stator plate is mounted on a stationary disc. The rotor plate faces the stationary stator plate with a refining gap between the plates. The rotor and stator plate may each be formed of plate segments. The segments of the stator plate may have similar bar and groove features as the rotor plate segment, or may have other bar and groove features. The rotational direction (see arrow 15) for the rotor plate is counter-clockwise. Alternatively, the rotor plate may face an opposing rotor plate (rotating in a clockwise direction) with a refining gap between the plates.

The inlet section 12 feeds the incoming fibrous material to the outer refining section 14, with minimal frictional energy and minimal work of the feed material. The inlet may have bars that form a coarse and open pattern, such as shown in U.S. Pat. No. 6,402,071, entitled "Refiner Plates With Injector Inlet" and issued to Luc Gingras.

A slippage area 16 is between the inlet 12 and outer refining areas 14 and may include triangular posts. The slippage area is an annular area that allows feed material discharged from the inlet section 12 to be properly distributed, e.g., uniformly distributed, before entering the outer refining section 14. The triangular posts in the slippage area promote uniform distribution of feed material entering the annular refining section 14.

The refining section 14 of the refiner plate segment is where most of the energy is applied to the feed material and most of the refining action occurs. The refining section 14 may extend over a radial distance of between 100 millimeters (mm) to 200 mm, or four to eight inches. The outer section may be comprised of curved bars 20 which have an increasing holding angle as they move radially outward to the outer edge of the plate. The holding angle may change gradually as shown in FIG. 2 or may be increased by providing a stepped change in the bar angle by forming each bar as a series of straight bars sections having different angles.

Grooves 21 are between the bars and are defined by the trailing sidewall 30 and leading sidewall 28 of adjacent bars 20. The leading sidewall faces the rotational direction (arrow 15) of the rotor plate. In FIG. 2, the leading sidewall 28 is on the left-hand side of each bar. The grooves provide passages through which feed material, steam and other materials move radially in the gap between the plates.

The height of the bars, e.g., the distance from the substrate surface 22 of the plate to the upper ridge of the bars 20 may be initially tapered and transition 24 to a uniform height for most of the length of the bars. The initial taper of the bars facilitates the feeding of material to the outer section 14.

The angle of the bars 20 at the inlet of the refining section 14 may vary from a 20 degree feeding angle to a 20 degree holding angle. These angles are the angle of the bars with respect to a radial line. The feeding and holdback inlet angles are angles that a bar 20 forms at the inlet to the bar. A feeding angle is a positive angle from a radial line in the same direction as the rotation as the rotor plate, e.g., counterclockwise 15. A holdback angle is a positive angle from a radial line in the opposite direction of rotation of the rotor plate. In the plate segment 10 shown in FIG. 2, the inlet angle is neutral, i.e., approximately zero degrees with respect to a radial line.

At the outer periphery 25 of the plate, the outlet angle of the bars 20 is preferably a holding angle of between 45 degrees and 80 degrees, and more preferably between 50 and 70 degrees. A holding angle is an angle with respect to a radial in the direction of the rotor plate rotation 15. The holding angle of the outlet to the bars inhibits the flow of fibrous material between the plates and thereby increases the retention time of the material in the refining section 14.

The angle of the bars gradually increases from the inlet to the outlet in an angular direction aligned with the rotation of the rotor plate. In the rotor plate embodiment shown in FIG. 1, the angle is neutral (zero) at the inlet and gradually increases along the bar in a direction towards the outer periphery 25 of the plate. The rate of change of the bar angle may be small at radially inward portions of the bar and gradually increase at radially outward portions of the bar. The bar angles from the radially inward edge of the refining section 14 to the radially outer edge may increase continuously in an curved arc, exponential arc or involute arc, or discontinuously such as in staggered rows of short bars. Further, the bars may be curved, a series of short straight sections (where each section has a greater angle that the prior inner section) or other lateral bar shape that achieves the desired increase in the angle of the bars. By increasing the angle of the bars to very wide bar angles at the outlet, the bars contribute to high retention of the feed material in the plate and increased retention time of the feed material in the refining section 14.

Retention of fibrous feed material in the refining section 14 is aided by the jagged leading sidewalls 28 of bars. The trailing sidewalls 30 of the bars may be smooth, jagged or have some other irregular surface pattern. Optionally, the width of the bars may vary due to the variable gap between the jagged surface on the leading sidewalls 28 and the smooth surface of the trailing sidewall 30.

The jagged pattern applied on the leading sidewalls 28 of the outlet bars may have irregular surface patterns along the length of the wall such as: zig-zag, sawtooth, a series of semi-circular bumps, sinusoidal, sideways Z-pattern, and other irregular surface shape features. The width of the bar may vary approximately by one fifth to one half, and preferably by one third, due to the irregular surface on the leading sidewall. The irregular surface shape features of the leading sidewalls provides increased longitudinal friction to the feed material moving through the grooves, particularly along the leading sidewall of the bars. The friction caused by the leading sidewall increases the retention period of the fibrous feed material in the refining section and promotes the movement of the feed material over the bars rather than through the grooves.

The smooth surface trailing sidewalls allow for relatively free passage of steam and other liquids through the grooves 21 which tend to be displaced by the feed material in the grooves and, thus, move along the trailing sidewalls. In some cases, the trailing sidewalls may include surface profiles shaped to cause additional turbulence in the fiber material flowing through the grooves to ensure an increased amount of turbulence in the flow, which can help push fibers towards the leading edges on the opposite side of the grooves. Further, the grooves may include may include surface dams, subsurface dams or steam management system dams, see, e.g., 64 in FIG. 10 and 74 in FIG. 12, to increase turbulence of the flow through the grooves, retain the fiber flow in the refining zone and reduce the flow of fibers in the lower region of the grooves. Due to centrifugal forces from the rotor disc, fiber and other solid materials tend to move along the leading sidewalls of the grooves. The jagged leading sidewalls slow the flow of fibrous material through the grooves in the refining section.

Figure 4:
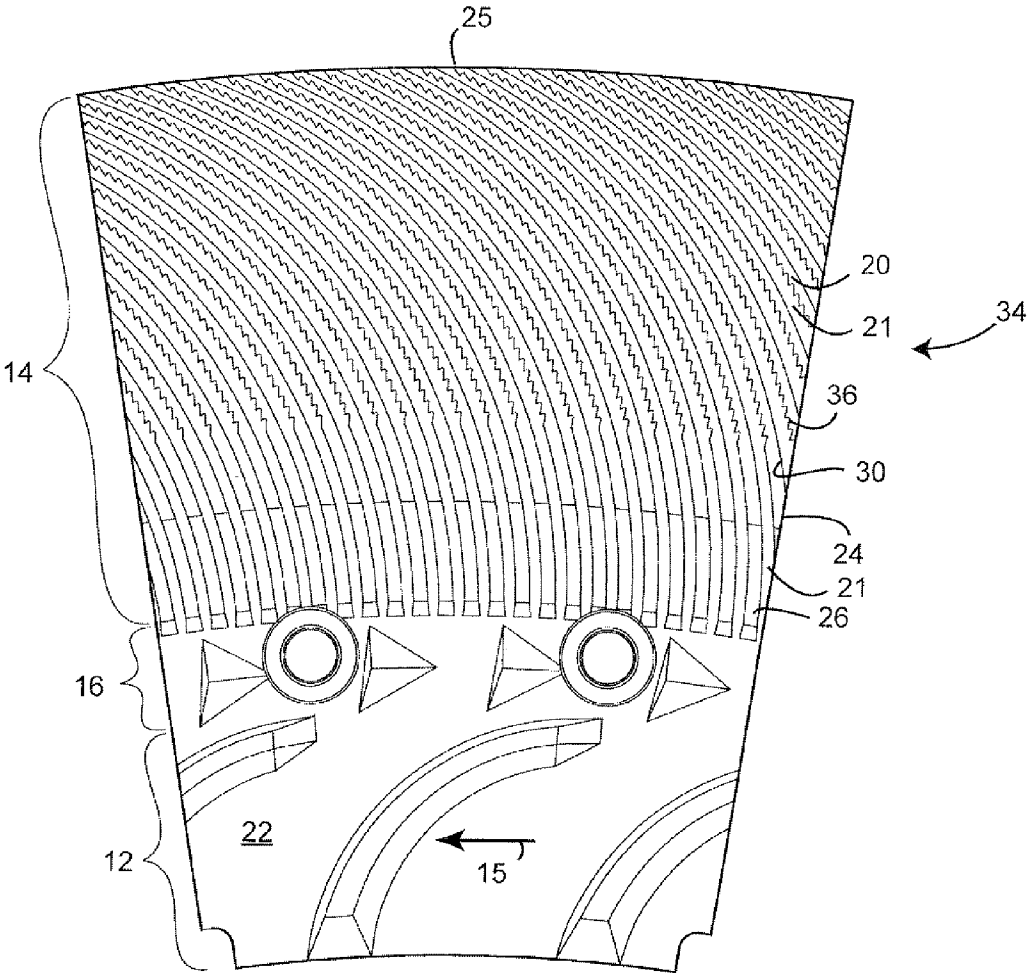
FIG. 4 is a front view of the refiner plate segment shown in FIG. 3 and shows refining bars with a jagged leading sidewalls shaped as a series of "7" arranged end-to-end.
Figure 3:
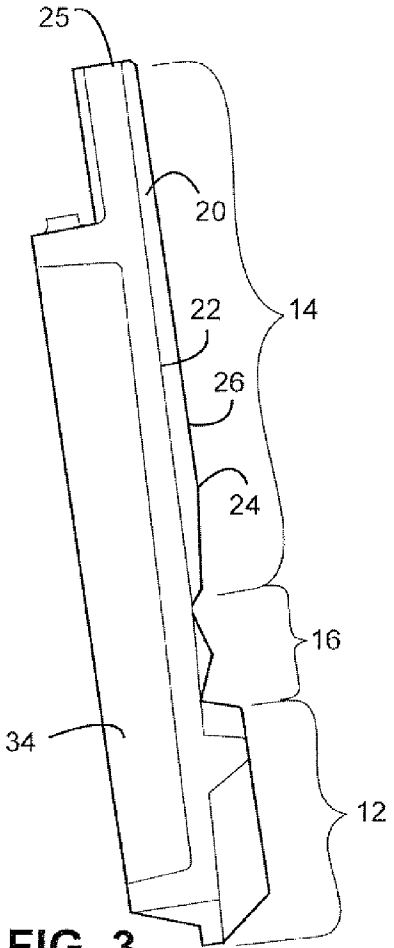
FIG. 3 is a side view of a second rotor refiner plate segment.

FIGS. 3 and 4 shown a side view and front view, respectively, of a plate segment 34 having bars 20 with a jagged leading sidewall 36 that appears from a top down view of the bar as a series of number sevens ("7") arranged end-to-end. The corners formed by the series of sevens may be rounded to ease manufacture and molding of the plate segments. The leading sidewall 36 surface features may extend the entire length of the bar wall surface, or may extend along just a radially outer portion of the bar (as shown in FIG. 2). In addition, the jagged leading sidewall may be may be tapered from the ridge 26 towards the root (at the plate substrate surface 22) of the bars, so that the jagged feature is most prominent at the upper corner edge of the bar where most refining is accomplished and becomes less significant along the depth of the bar, particularly deep in the groove. The grooves provide hydraulic capacity to moving feed material, steam and water through the refining section of the refiner plates.

The jagged features on the leading sidewall 28 can vary in size and shape. Preferably, the outer protrusions of the jagged corners, e.g., points on a saw-tooth shape and corners in a series of "7" shape, are spaced apart from each other by between 2 mm to 8 mm along the length of the bar sidewall. The protrusions of the jagged sidewall surface features have a depth of preferably between 1.0 mm to 2.5 mm, where the depth extends in to the bar width. The depth of the protrusions may be limited by the width of the bars. A bar 20 typically has an average width of between 2.0 mm and 6.5 mm. The bar width varies due to the jagged sidewall surface features, particularly the protrusions, on the leading sidewall.

Figure 6:
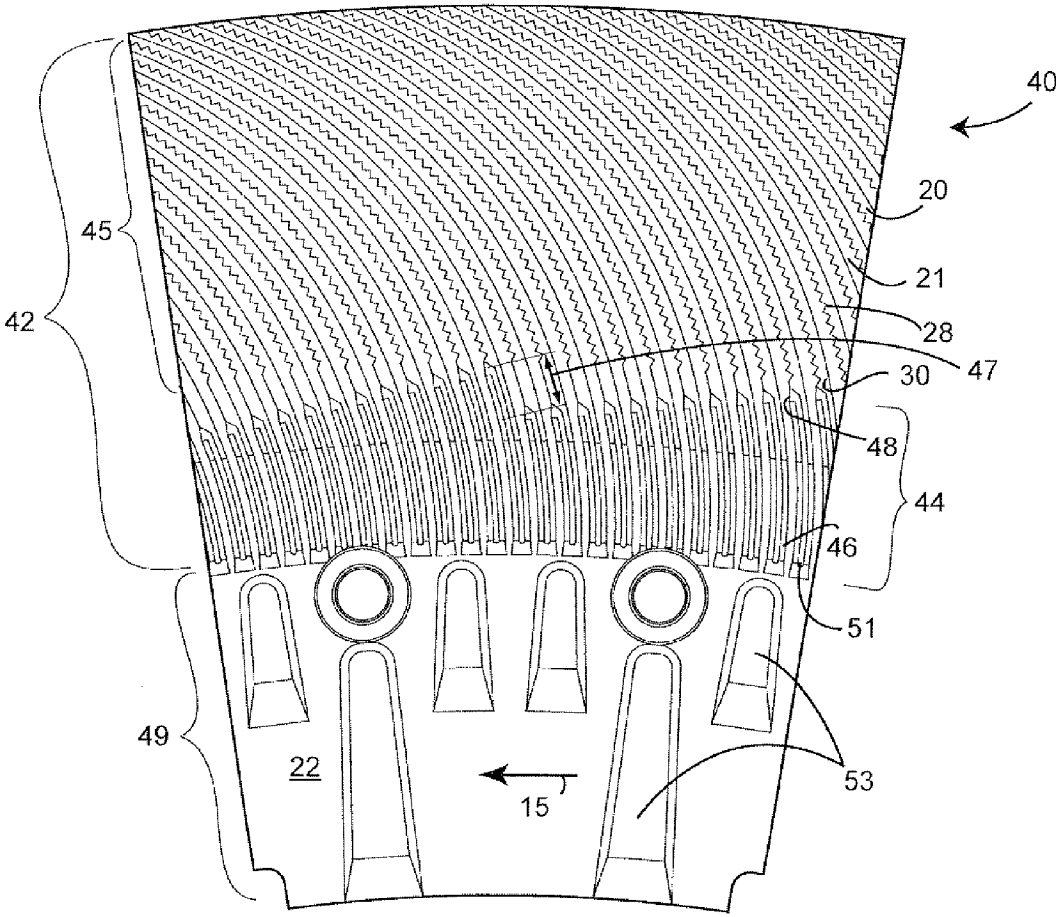
FIG. 6 is a front view of the refiner plate segment shown in FIG. 5 and shows refining bars having an outer zone with a fine inlet region.
Figure 5:
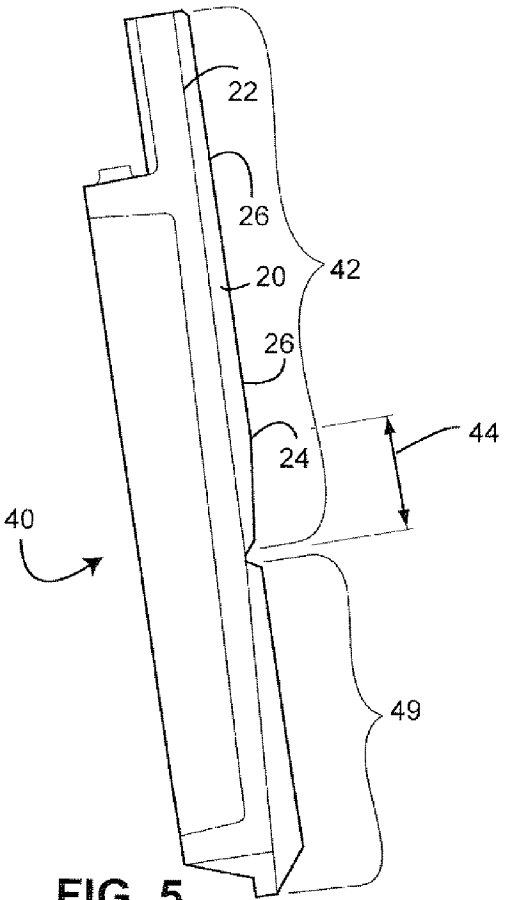
FIG. 5 is a side view of a third rotor refiner plate segment.

FIGS. 5 and 6 show a side view and front view, respectively, of a rotor refiner plate segment 40. The outer zone 42 includes a radially inward section 44 having a fine inlet for breaking down feed material to produce high quality pulp. The inward section 44 forms the inlet to the outer zone 42 of the bars. The inward section of each bar 20 has a fine groove pattern 46 in the ridge 26 of the bar. The fine groove is in addition to the grooves 21 between adjacent bars.

The inward section 44 of the outer zone 42 may be formed by bars having a tapered ridge that gradually increase in height to a transition 24 and continues radially outward in the outer zone, as shown in FIGS. 2 and 4. Alternatively, the bars in the inward section may each include a fine groove 46 that effectively doubles the number of bars in the inward section 44 as compared to the bars radially outward of the inward section. A finer bar pattern in the inward zone 22 provides lower intensity separation of the raw feed material to better preserve the fiber length and strength properties from the raw material.

The rotor plate 40 has a refining zone 42 in which the initial refining work on the feed material is achieved with a finer bar pattern on inward section 44, in contrast to the coarse bar pattern in remaining portion 45 of the refining zone. One use of having an initial fine refining pattern in the inward section is where there is a requirement for high pulp quality. In the inward refining section 44, the fine bar pattern results in lower intensity compressions to the fibrous material that the stronger compressions that would occur with the coarse bar pattern in the inward refining section pattern shown in FIG. 2 and with the coarse bar pattern of the outer refining section 45 of FIG. 6. The lower intensity compressions of the fine bar pattern of section 44 preserves the properties of the fiber to a greater extent than if high intensity compressions are applied over the entire primary refining zone 42.

An alternative exemplary bar and groove pattern for the inward section 44 is shown in U.S. Pat. No. 5,893,525 (incorporated fully by reference) which shows a series of fine bars which are narrow and greater in number than the bars in a radially outer portion 42. Other bar and groove patterns with fine, narrow bars may also be appropriate, depending on the plate design, the material to be refined, and the intended purpose of the plate. Alternatively, the number of bars in the inward refining section 44 may be coarser and less dense, such as shown in section 60 of FIG. 8, than the density of bars in the outer refining zone 45.

The transition zone 47 between the inward refining zone 44 and outer refining zone 45 may include cutting bars, a narrow annular gap between separate bar sections in zones 44 and 45, or connecting bars between the zones 44, 45. The transition zone may include cross-over grooves 48 in the narrow bars 46 of the inner refining section. The cross-over grooves allow material flowing through shallow grooves 51 in the inner refining section 44 to deeper grooves 21 in both the inner and outer refining sections 44, 45. The cross-over grooves also allow the number of bars to be reduced, such as in one-half, in the transition zone 47. The cross-over grooves may extend radially outward to a leading or trailing sidewall of an adjacent bar. The cross-over grooves 48 open through a leading sidewall 28 in the bars radially inward of the jagged section of the leading sidewall of the bars 20. The cross-over grooves 48 may be arranged on the plate segment in a Z-pattern, such as shown in U.S. Pat. No. 5,383,617, to promote feeding of material into the main grooves 21 between the bars. As an alternative to cross-over grooves, a downwardly sloping ramp at a radially outer bar end may terminate bars that do not continue into the next refining zone.

In the Z-pattern, the cross-over grooves 48 are aligned along a line that is not tangent to the refiner plate. This line of alignment for the cross-over grooves shifts 48 at least once on the plate segment 40. While the cross-over grooves form a Z-shape, other arrangements of the cross-over grooves may be used such as aligning the cross-over grooves at a common radial distance, along straight lines in each plate segment and in a "W" shape.

The refiner plate may include a feed material inlet zone 49 that is radially inward of the refining zone 42. The inlet zone 49 may include straight breaker bars 53 or curved breaker bars as shown in FIG. 2. Preferably, the inlet zone 49 (FIG. 6) or 12 (FIG. 2) forwards the feed material into the refining zone 42, 14 with minimum energy input. There are numerous known variations of bar patterns for the inlet zones 12, 49. It is a matter of design choice as to which inlet zone variation is most appropriate for a particular plate design. The inlet zone affects the ability of the refiner to break down the feed material, handle steam and distribute feed. The inlet zone directs the fibrous feed material to the refining zones 14, 44 where most of the refining of the feed material is performed.

Figure 8:
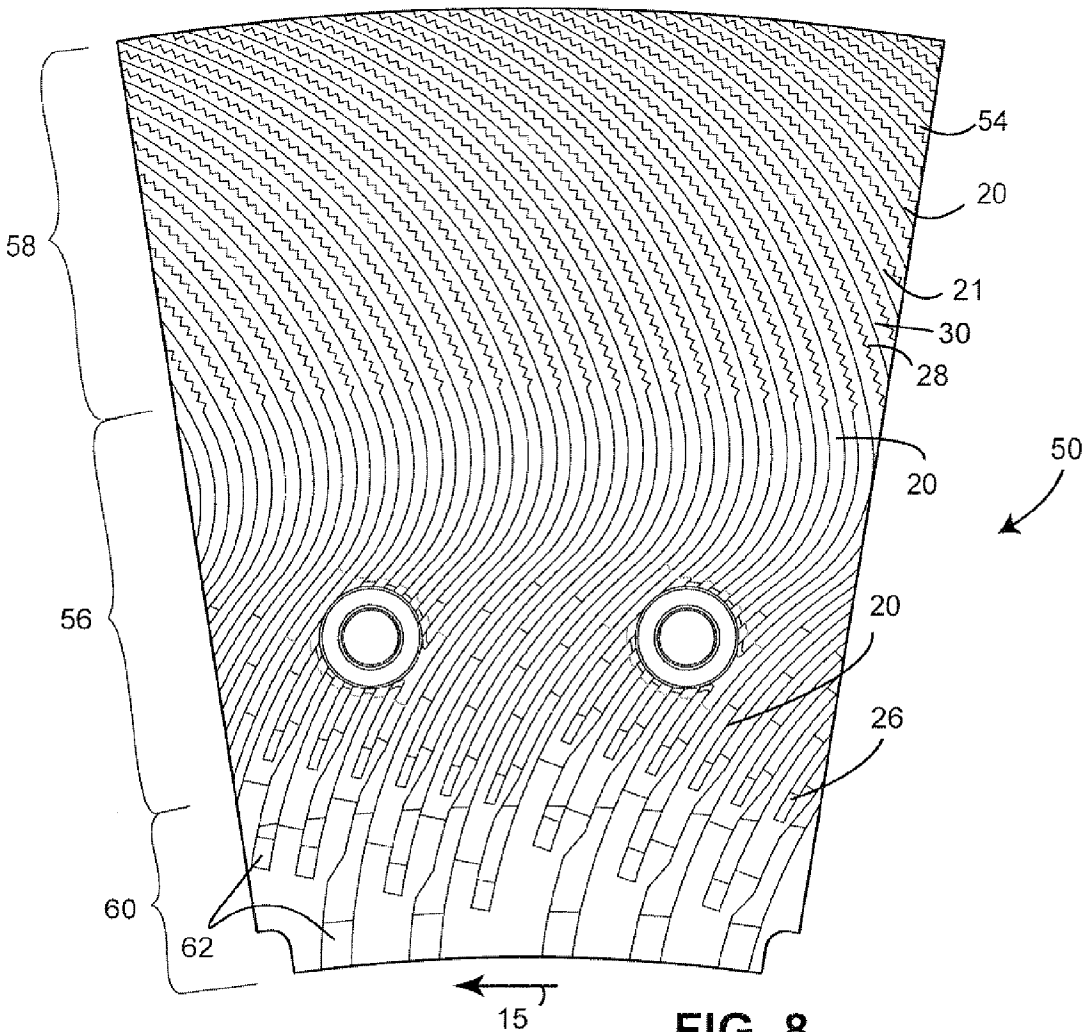
FIG. 8 is a front view of the refiner plate segment shown in FIG. 7 and shows refining bars with an extended refining zone towards the plate inlet.
Figure 7:
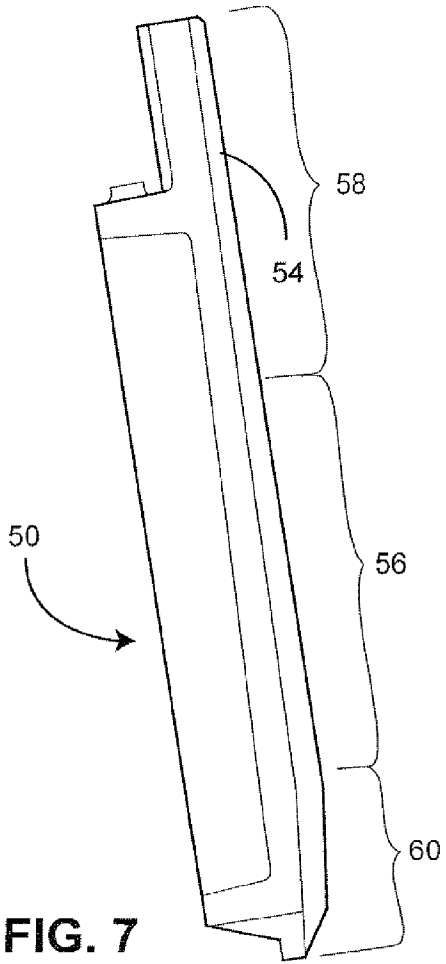
FIG. 7 is a side view of a fourth rotor refiner plate segment.

FIGS. 7 and 8 are side and front views, respectively, of a refiner rotor plate segment 50 having an extended outer zone 58 with serpentine bars 54. The inward feeding 56 of the bars 20 feed the fibrous material to the outer refining section 58, so that the feed material can be broken down gradually without excessive energy being applied. The inlet to the feeding section 56 may have bars with feed angles of between 10 and 45 degrees. These feeding angles may remain constant through the feeding section. Alternatively, the angles of the bars may change gradually from a feed forward angle at the inlet to a reverse angle at the outlet edge of the feeding section 56. By providing a positive feeding effect on the feed material, the feeding section there is less accumulation of fibrous material in the feeding section 56 and thus less energy is applied this section. The main energy application should be in zone 58. Feeding section 56 should be a feeding zone with some effect on particle size reduction, but not a large energy input. The selection of the angles and geometry of bars and grooves in the feeding section 56 is a design choice and can be varied to achieve good feeding of fibrous material to the outer refining section 58 or other desired refining effects. Preferably, the bars 20 in the feeding section 56 continue to the radially outward refining section 58. Alternatively, the bars 20 in the feeding section 56 may end before the inlet edge of the outer refining section 58. To provide a transition from the inward annular section 56 to the outward annular section 58, an annular transition zone may separate the bars from the feeding section 56 from those of the outward refining section 58. The transition zone between the annular sections 56, 58 may include a Z-pattern or chevron (W) pattern, such as is shown in FIGS. 6, 12, 25 and 27

The bars of the inner zone 60 are coarser and less dense than the bars of the sections 56, 58, which has double the density of bars than in the inner zone 60. A coarse bar pattern may assist in feeding material to the bars in the radially outward section(s). However, a coarse inlet may result in a coarse breaking down of the raw material (such as wood chips) and in fiber cutting, which is desirable for certain refining applications.

The bars in the outer refining sections or zone 58, 42 and 14 of the refiner plate segment may have a variety of geometries to provide various desirable performance features, such as extended feed material retention. Curving the bars along their length in a radial direction increases the hold angle and thereby increases retention time. Applying a jagged or otherwise irregular surface on the leading sidewall of the bars further promotes retention time of feed material, e.g., fibers, in the outer zone and thereby increases the amount of refining performed on the feed material. The jagged leading sidewall surface on the bars may extend the length of the bars in the outer zone or may be limited to a radially outward section, e.g., the outer half of the outer zone.

The inlet zone 60 of the refiner plate segment 50 has a large feeding angle to minimize the retention time of feed material in the inlet zone. In addition, the staggered bar inlets 62 form large operating gaps at the entrance of the inlet zone. The combination of large operating gaps and short retention in the inlet zone, result in a small amount of energy being consumed in the inlet zone and thereby increases the energy efficiency of the plate. The energy savings from the inlet zone may be applied to concentrate the energy applied to the refining area at the radially outer 58 sections of the plate segment 50. While the bars in the inlet zone 60 need not be curved, they preferably have a significant feed angle to minimize retention in the inlet. However, other bar shapes and angles may be used in the inlet zone 60 depending on the feed material and the need to break down feed material in the inlet zone.

The inlet zone 60 of rotor plate segment 50 has a smaller operating gap as compared to the inlet zones in the other rotor plate segments 10, 34 and 40, disclosed herein. The operating gap is the radial distance occupied by the inlet. A narrow gap indicates that the refining zone (outer zone 58) begins at a relatively small radius of the plate segment. A narrow gap may achieve material pre-separation and fiber shortening.

The jagged leading sidewall surfaces 28 of the bars 20 are applied only in the outer few inches of the plate segment in refining section 58. In addition, this outer section 58 has the bars 20 with substantial holdback angles, such as greater than an average angle of 20 degrees. The jagged bar surfaces and holdback angles in the outer few inches of the refining zone concentrate fiber pad formation and energy input in the outer section 58 of the plate segment 50.

Most of the refining energy applied by rotor plate 50 will be applied in the refining section 58. The large holdback angle of the bars in section 58 and the jagged leading sidewall surfaces of the bars retain the fibrous material in section 58. The increased retention time allows a greater portion of the refining energy to be applied in section 58. In contrast to section 58, the strong feeding angles of the bars and smooth sidewall surfaces in section 56 result in a reduced amount of energy transfer in this section of the plate 50. Accordingly, a large portion of the refining work done by plate 50 is concentrated in the refining section 58, even though this section has same number of bars as does section 56.

Figure 10:
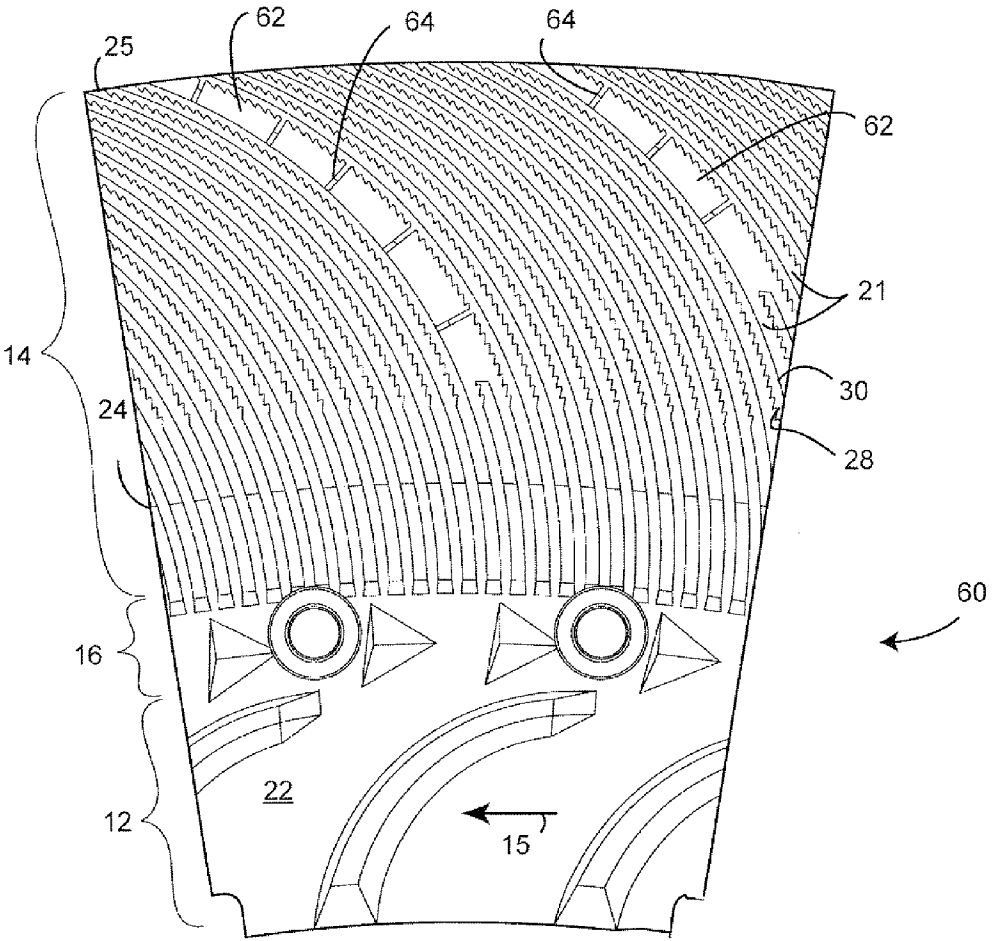
FIG. 10 is a front view of the refiner plate segment shown in FIG. 9 and shows an outer refining zone with steam channels.
Figure 9:
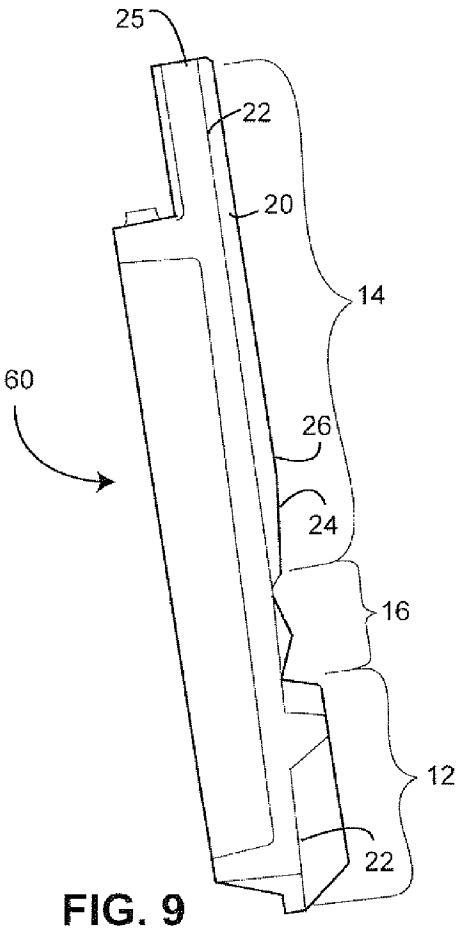
FIG. 9 is a side view of a fifth rotor refiner plate segment.

FIGS. 9 and 10 show a side view and front view, respectively, of a refiner plate segment 60 having steam evacuation channels 62. These channels tend to be at least as wide as the combined width of a groove and bar. The channels are between and parallel to two bars and may extend the length of the portion of the bars having an irregular leading sidewall. The steam evacuation channels allow steam to vent through the wide channels 62 and radially outward from the outer periphery 25 of the plate. The channels may include dams 64, e.g., split dams in which a leading region of the dam is lower than a trailing portion of the dam to allow trap fibers in the channel but allow steam to pass through the channel. Examples of split dams are shown in U.S. Pat. No. 6,607,153.

The grooves 21 separating the bars 20 may have a combination of surface dams, subsurface dams, or even no dams at all, depending on the overall plate design combination and operational conditions for the refiner plate.

Figure 12:
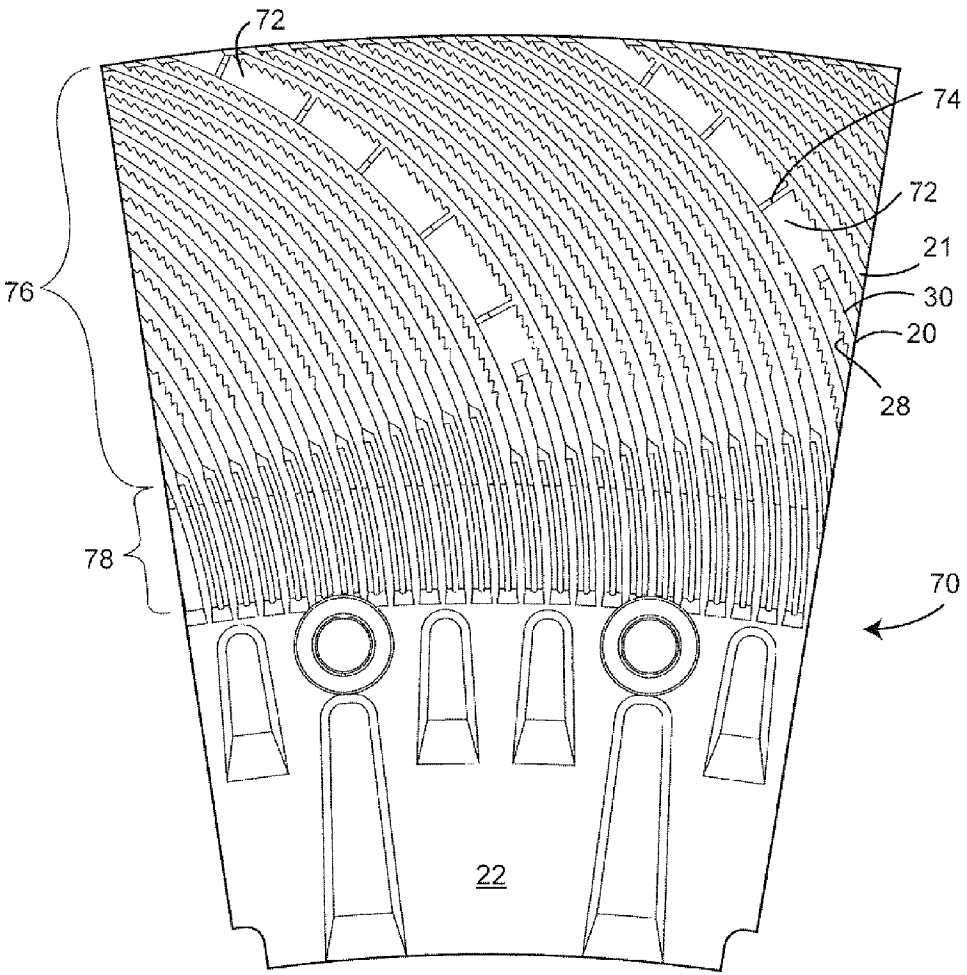
FIG. 12 is a front view of the refiner plate segment shown in FIG. 11 and shows an outer refining zone with steam channels and an inner refining zone with a fine bar pattern.
Figure 11:
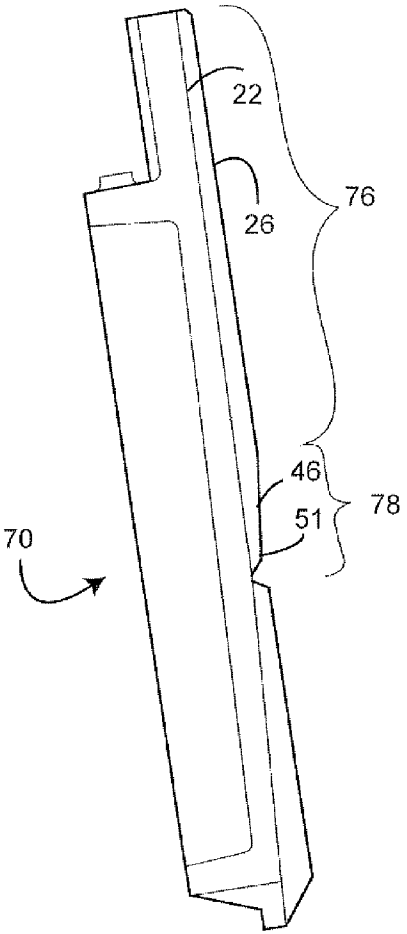
FIG. 11 is a side view of a sixth rotor refiner plate segment.

FIGS. 11 and 12 show a side view and front view, respectively, of a refiner plate segment 70 having steam evacuation channels 72. The steam evacuation channels allow steam to vent through the wide channels 72 and radially outward from the outer periphery 25 of the plate. The channels may include dams 74, e.g., split dams. The channels 72 and grooves 21 separating the bars 20 may have a combination of surface dams, subsurface dams, or even no dams at all, depending on the overall plate design combination and operational conditions for the refiner plate.

The outer refining zone 76 includes the steam channels 72, aggressive holdback angles, e.g., 45 degrees, on the bars, and serrated surfaces on the leading sidewalls 28 of the bars. Arranging the serrated surfaces and aggressive holdback angles towards the outer refining portions of the rotor plate segment 70 increases retention time of the feed material in the refining zone(s) of the plates and concentrates the energy applied by the plates to the refining process occurring in the outer regions of the refining zone.

The inner refining zone 78 has a fine refining pattern, similar to the pattern shown in zone 44 for the rotor plate segment 40. The various refining and inlet patterns and features shown on the plate segments disclosed herein may be rearranged and combined to form additional rotor plate designs that incorporate the substance of the plate patterns and features disclosed herein but differ in some respects from the plate segments 70, 60, 50, 40, 34 and 10. In other words, the plate segments disclosed herein are exemplary and provide a person of ordinary skill in the art of designing refiner plate segments with sufficient information to design plate segments that incorporate the refining features disclosed herein, such as refining bars with serrated leading sidewalls and aggressive holdback angles, e.g., greater than 45 degrees, in the outer radial sections of the refining zone(s).

By increasing the retention time in the refining zone and concentrating energy to refining, the rotor plates disclosed herein, e.g., 70, 60, 50, 40, 34 and 10, provide high energy efficiency refining without necessarily having to reduce the refining gap between the plates, e.g., rotor and stator plates, to the same extent, e.g., 0.5 millimeters (mm) to 0.7 mm, conventional used in high energy efficiency plates. Using the rotor plate segments disclosed herein, the refining gap, for example, may be between 0.7 mm and 1.0 mm, which is similar to the refining gap used with conventional plates, or may be increased to 1.2 mm to 2.0 mm. Increasing the refining gap tends to increase the operational life of the refiner and stator plates and reduce the occurrences of breakage of the refining patterns on the plates.

FIGS. 13 to 16 are each a top down view of the ridge 26 and particularly the profile of the irregular surface on a leading sidewall of a bar in the outer refining zone of a refiner plate segment. The upper ridge 26 of each bar 20 includes a profile of the upper corner of the leading sidewall 28 and the trailing sidewall 30. The leading sidewall has an irregular surface, e.g., serrated feature, that may be most pronounced at the upper corner of the sidewall. The irregular surface features of the leading sidewalls 28 may be confined to the outer radial portions of the bar, but may extend the entire length of the outermost refining zone or the entire refining zone.

The irregular surface features may have a variety of shapes, including the series of "7"s shown in FIG. 13, the saw tooth feature shown in FIG. 14, the series of concave grooves in the leading sidewall as shown in FIG. 15, a series of teeth, e.g., rectangular teeth, as shown in FIG. 16 and any such shape that will increase friction in the fiber flow along the leading edge of the bars. The shape of the irregular features is intended to increase friction applied to fibers moving along the leading sidewall. The shape of the irregular sidewall may depend on the feed material, and plate segment composition, manufacturing and molding considerations.

FIG. 17 shows in cross section a bar 20 having a irregular trailing sidewall 300, e.g., a series of "7"s, and an irregular surface, e.g., a series of "7"s, on the leading sidewall 28. The irregular surface 300 of the trailing sidewall is optional and may have a surface shape of any of the irregular surfaces shown herein for the leading sidewall. An irregular surface on the trailing sidewall may assist in pushing fibers moving along in the trailing wall towards the leading sidewall.

FIG. 18 shows in front view the same irregular surface feature on the bar leading sidewall as shown in FIG. 18. The irregular surface feature may be more pronounced on the bar sidewall near the bar ridge 26 where most refining occurs. The irregular surface feature may become progressively less pronounced on bar sidewall in the direction of the plate substrate 22. The protrusions 76 of the irregular surface tend to retard the movement of feed material through the grooves and thereby increase the retention time of feed material in the refining zone(s) of the plates. The protrusions 76 may be tapered from ridge 26 to substrate 22. Near the substrate 22 of the plate the protrusions may blend into a smooth lower surface 78 of the leading sidewall 28.

Figure 19:
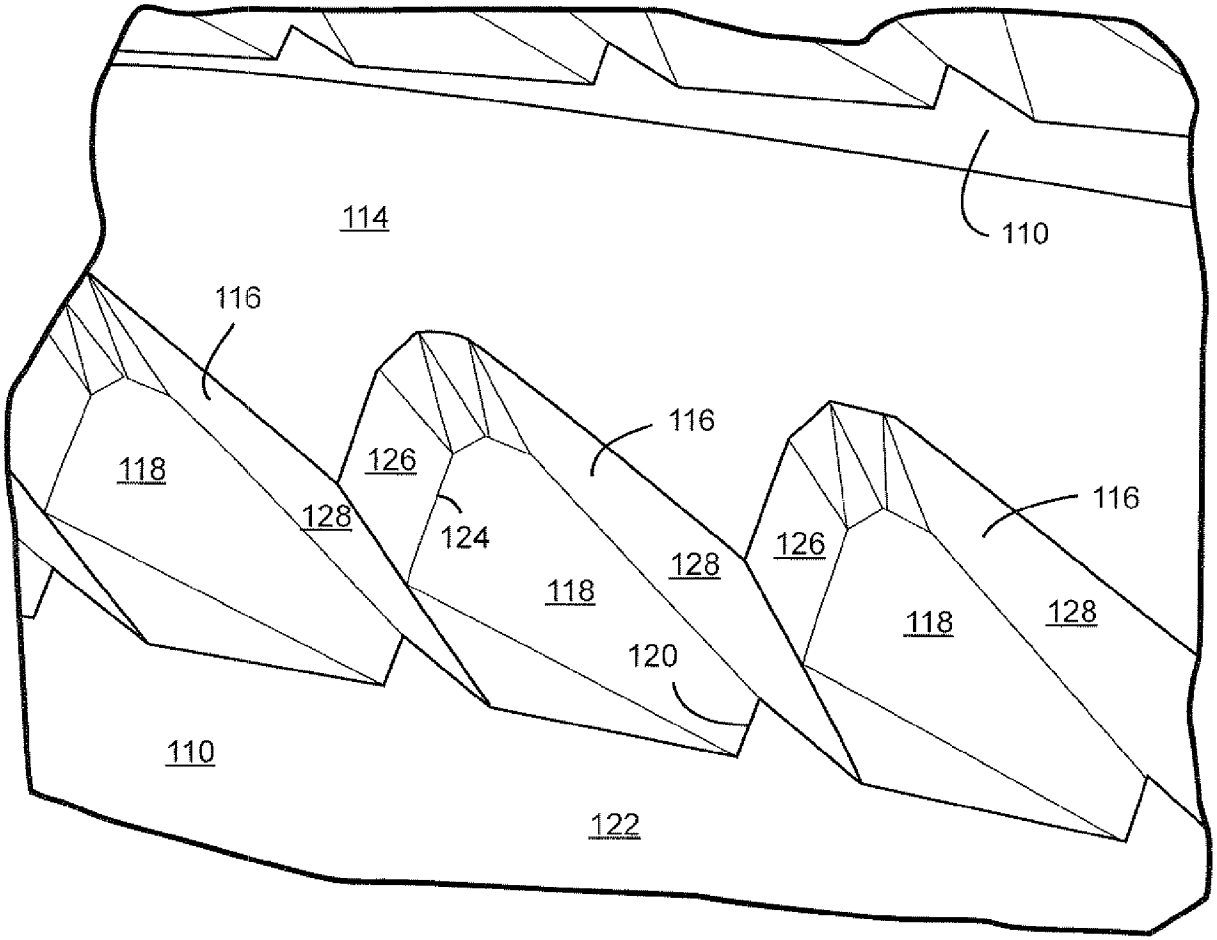
FIG. 19 is an enlarged view of the bars of a rotor plate having staggered teeth at an upper edge of the bars.

FIG. 19 is a schematic diagram of an enlarged view of a bar 110 on a rotor plate with a groove 114 between adjacent bars 110. The upper portion, e.g., upper one third, of each bar 110 includes a row of teeth 116 each having a side face 118 slanted to push fibers moving over the bars into the next groove 114. The side face 118 of each tooth has a leading edge 120 that is aligned with the sidewall 122 of the bar. A trailing edge 124 of the side face 118 may be recessed into the bar by, for example, a third of the width of the bar. A rear surface 126 of each tooth may be substantially perpendicular to the plate. A sloped front surface 128 may meet the rear surface of the next tooth and assist in pushing fibers up into the gap between the stator and rotor plate.

Figure 21:
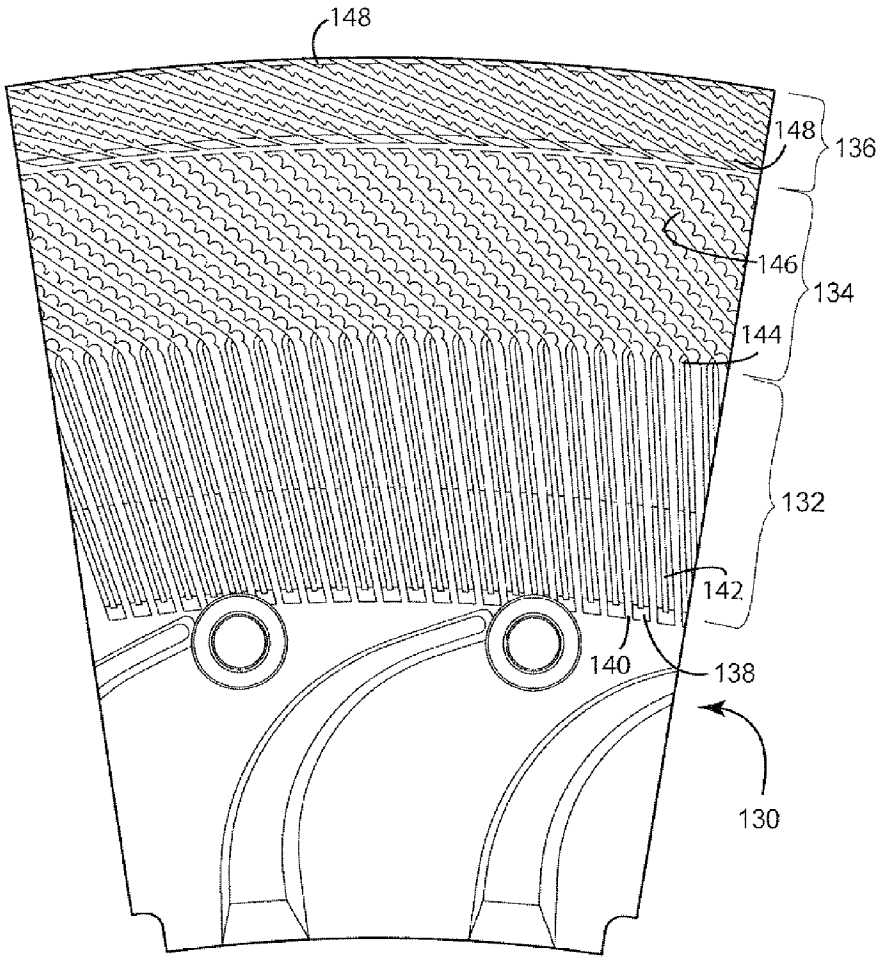
FIG. 21 is a front view of the refiner plate segment shown in FIG. 20 and shows an outer refining zone with steam channels.
Figure 20:
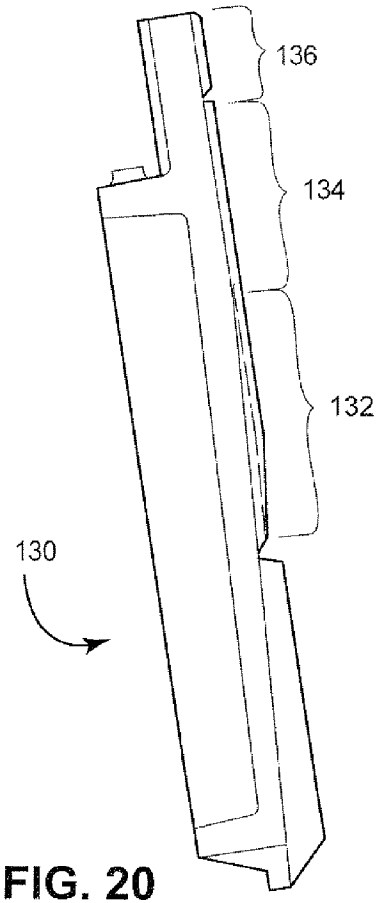
FIG. 20 is a side view of a seventh rotor refiner plate segment.

FIGS. 20 and 21 are side views and front views, respectively, of another exemplary rotor plate segment 130 having an inner fine refining zone 132, a middle refining zone 134 and an outer refining zone 136. The fine refining zone includes bars 138 separated by deep grooves 140. Each bar has a shallow groove 142 that effectively divides each bar into a pair of bars and thereby doubling the number of bars in the fine refining zone. Cross-over channels 144 at the outer edge of the fine refining zone directs fiber and liquor in the shallow grooves 142 out through the trailing edge of the bar and into a groove at the inlet to the middle refining zone 134. The leading sidewalls 146 have an irregular surface, such as a series of half-cylinders that are most pronounced at the upper edge of the bars. The bars terminate at the outer edge of the middle zone. The bars 148 of the outer refining zone 136 are substantially the same in number as the bars in the middle zone 134. The leading sidewall surface of the bars 148 have a shape of a series of "7" arranged end to end. The irregular surfaces of the sidewalls of the bars in the middle and outer refining zones increases the friction applied to the fibers flowing in the grooves and thereby increases the retention time of the fibers in those zones.

Further, the bars in the inner, middle and outer zones 132, 134 and 136 are relatively straight on the rotor plate segment 130. The angle of the bars increases from zone to zone. For example, the angle of the bars in the inner zone is relatively shallow, e.g., zero degrees to 10 degree holdback angle. The angle of the bars in the middle zone is more aggressive, such as 20 degrees to 40 degrees, and the angle of the bars in the outer zone is most aggressive, such as greater than 45 degrees and may be 60 degrees or 70 degrees.

Figure 23:
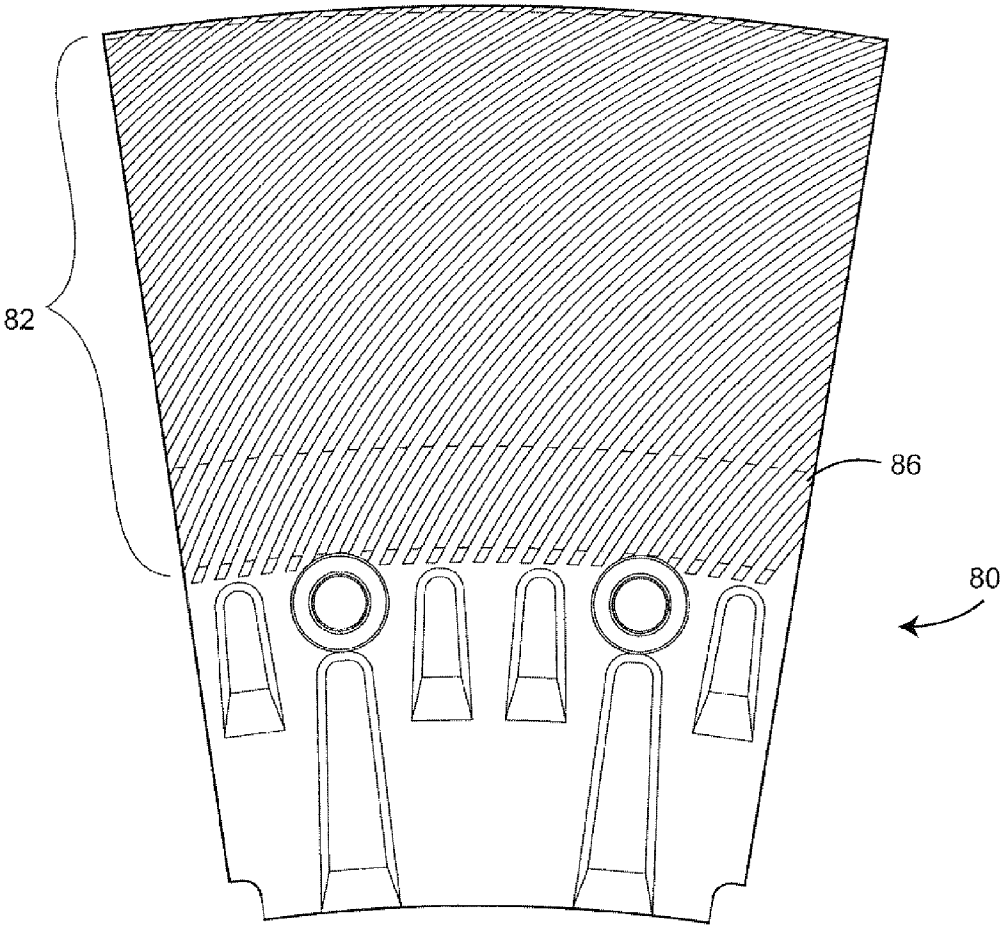
FIG. 23 is a front view of the stator plate segment shown in FIG. 22.
Figure 22:
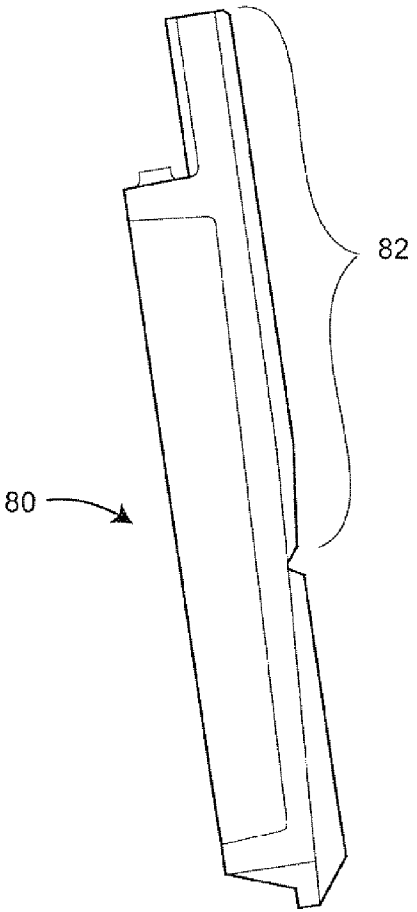
FIG. 22 is a side view of a first embodiment of a stator refiner plate segment.

FIGS. 22 and 23 are side views and front views, respectively, of an exemplary stator plate segment 80. The refining bar and groove patterns disclosed herein are most applicable to rotor plates but may be applied to stator plates. The stator plate 80 may have an outer zone 82 with bars 84 that are curved, e.g., exponentially or in an involute arc, to increase retention time of feed material in the refining outer zones of the rotor and stator plates. The leading and trailing sidewalls of the stator bars 84 may have smooth wall surfaces. Jagged sidewalls may not be needed on the bars of the stator plate, because the centrifugal forces acting on the feed material in the grooves 86 in the stator plate are reduced as compared to those forces on material in the rotor plate. Further, the bars of the stator plate segment may have various patters of feed and holding angles and bar shapes depending on the application of the refiner and the selected rotor plate pattern.

The stator plate segments are arranged in an annular array on a stationary disc of a refiner machine. Similarly, rotor plate segments are arranged in an annular array on a rotating disc of the refiner machine. The arrays of stator plate segments and rotor plate segments are opposite to each and separated by a narrow gap through which fibrous material passes during the refining process. The fibrous material may be fed into the gap by passing through a center inlet in the stator disc and the array of stator plate segments.

Figure 25:
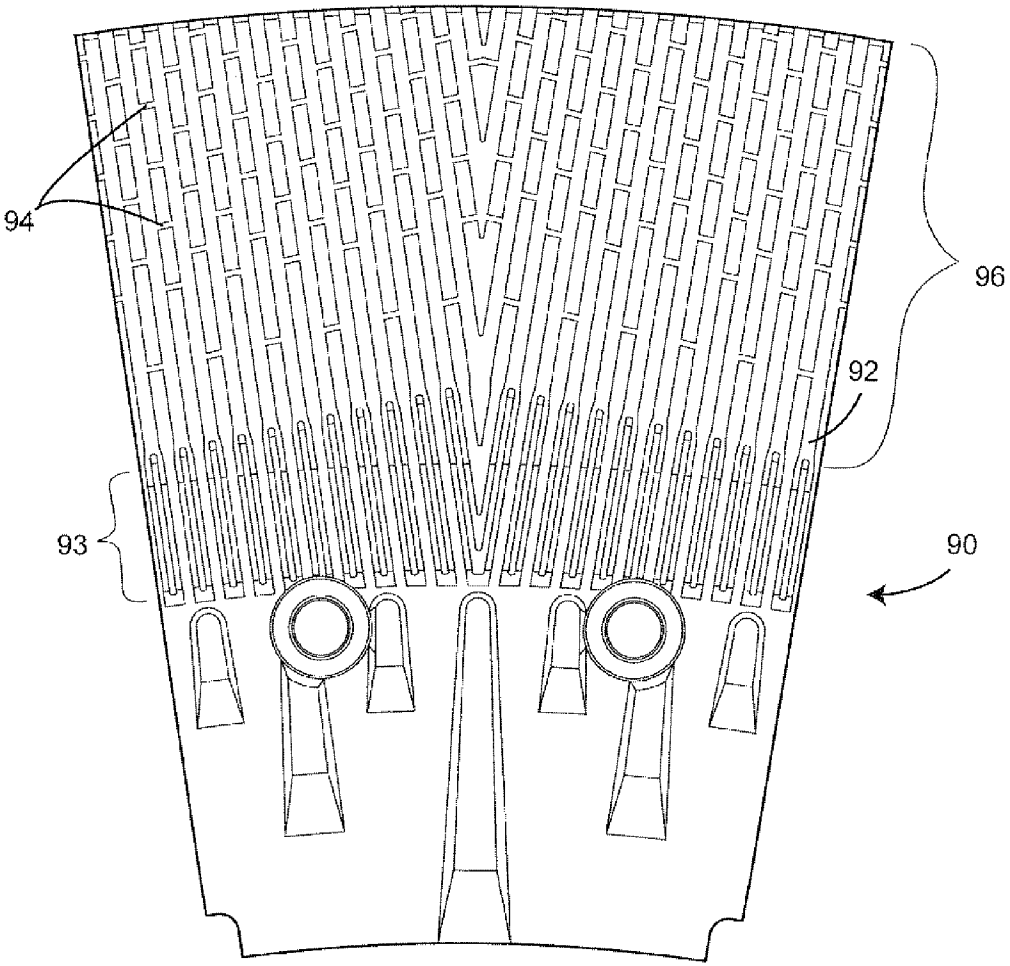
FIG. 25 is a front view of the stator plate segment shown in FIG. 24.
Figure 24:
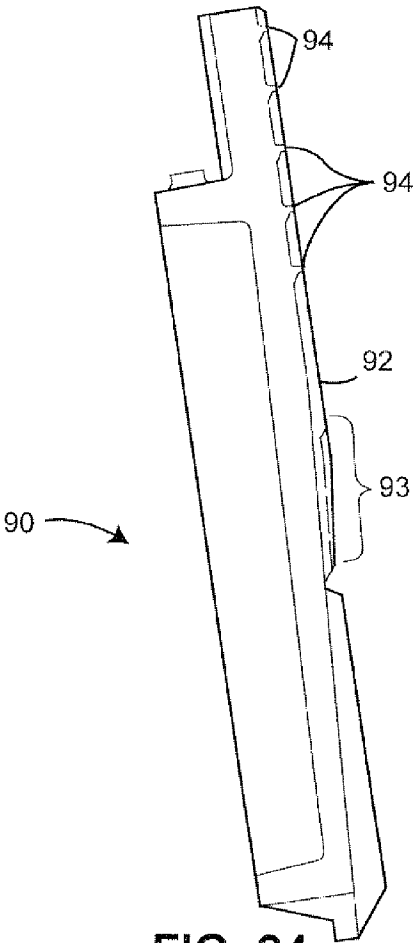
FIG. 24 is a side view of a second embodiment of a stator refiner plate segment.

FIGS. 24 and 25 are side views and front views, respectively, of a second exemplary stator plate segment 90. The stator plate segment 90 may be used in conjunction with the rotor plates 40 and 70. The bars 92 at an inner refining zone 93 are split to form a fine refining pattern that is complementary to the fine refining bar patterns 44, 78 shown on the rotor plates 40 and 70. The stator bars 92 are substantially straight. The grooves between the coarse section 96 of bars include a series of dams 94 to increase retention time of the feed material in the refining zone.

Figure 27:
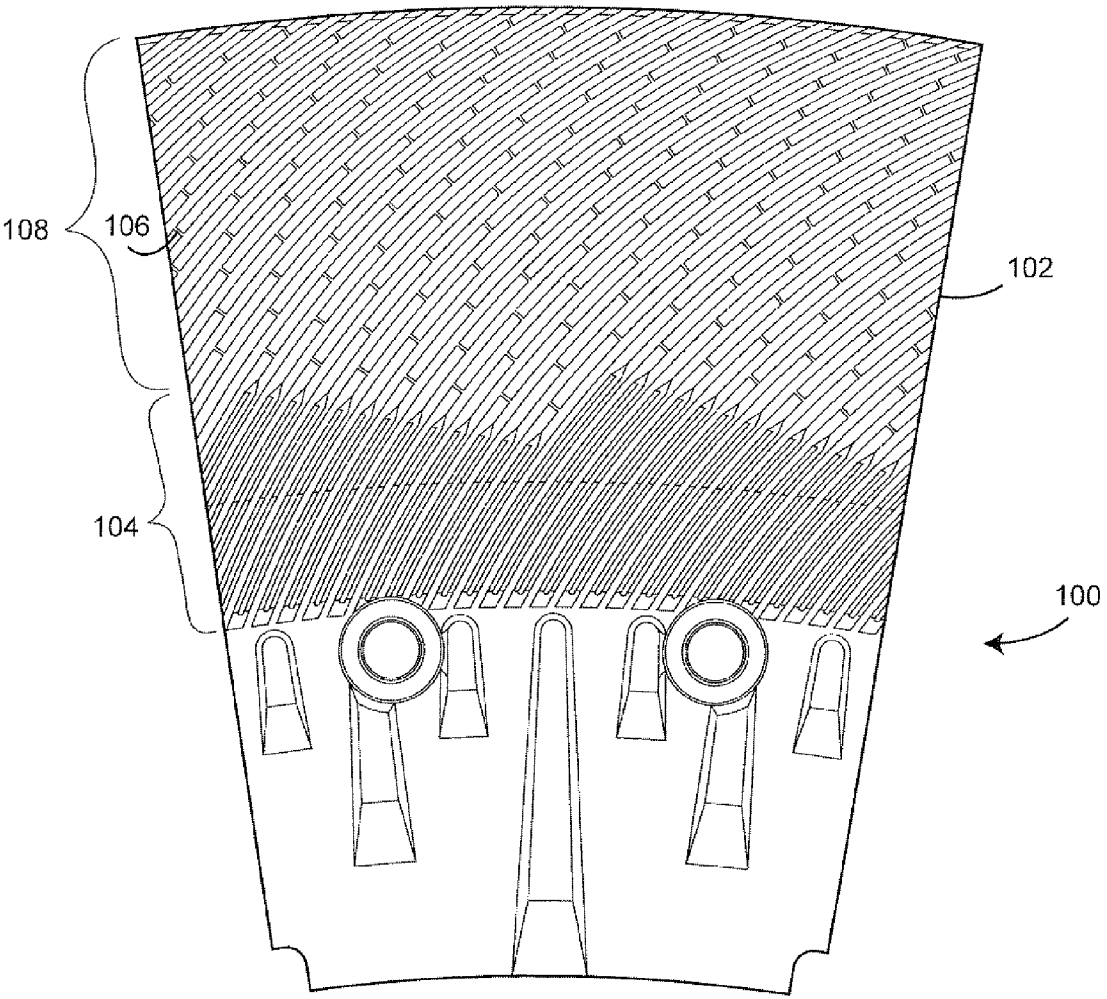
FIG. 27 is a front view of the stator plate segment shown in FIG. 26.
Figure 26:
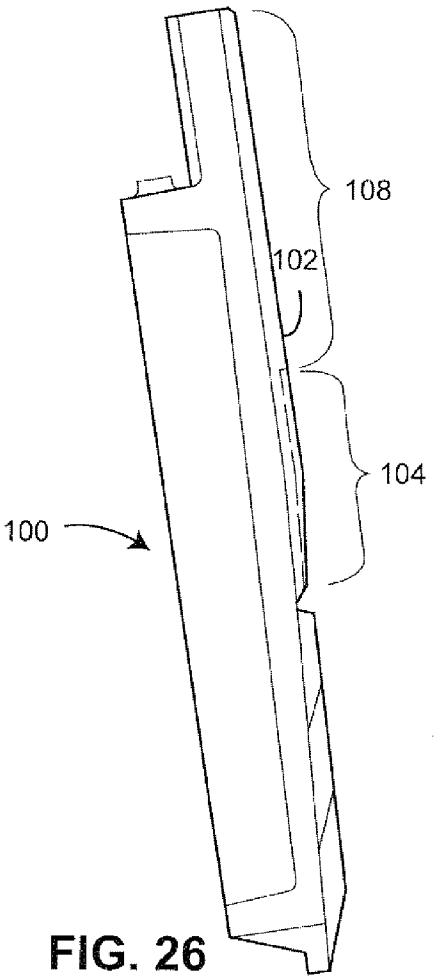
FIG. 26 is a side view of a third embodiment of a stator refiner plate segment.

FIGS. 26 and 27 are side views and front views, respectively, of a third exemplary stator plate segment 100. The stator plate segment 100 may be used in conjunction with the rotor plates 40 and 70. The bars 102 at an inner refining zone 104 are split to form a fine refining pattern that is complementary to the fine refining bar patterns 44, 78 shown on the rotor plates 40 and 70. The stator bars 102 are curved to provide a large holdback angle in the radially outward regions of the stator plate segment. The grooves between the bars 102 in a section 108 of coarse bars include a series of dams 106 to increase the retention time of the feed material in the refining zone. The stator and rotor plate design may operate in holdback or in feeding mode, depending on the required operating gap, fiber retention and refining results. The stator plate 100, due to its large feeding (or holding) angle can cause great influence in operation with the rotor plates shown herein with features, such as aggressive holdback angles and jagged leading sidewalls. Accordingly, the stator plate may complement the desired longer retention time in the refining zones in the outer sections of the plates, which is achieved with the rotor plates disclosed herein.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner plate for a mechanical refiner of lignocellulosic material comprising:

a refining surface on a substrate, wherein the refining surface is adapted to face a refining surface of an opposing refiner plate, and the refining surface including bars and grooves between the bars, wherein the bars have at least a radially outer section having a holdback angle of at least 30 degrees at the outer periphery of the bars, and the bars each include a sidewall having an irregular surface in the outer section, wherein the irregular surface include protrusions extending outwardly from the sidewall towards a sidewall on an adjacent bar, wherein the bars include a radially inward section in which the sidewalls have a smooth surface and lack the irregular surface.

2. The refiner plate of claim 1 wherein the protrusions of the irregular surface form a pattern that is at least one of a zig-zag, sawtooth, series of bumps, sinusoid, and sideways Z-pattern.

3. The refiner plate of claim 1 wherein the protrusions on the irregular surface vary a width of the bar by at least one-fifth the width of the bar along the portion of the bar having the sidewall with the irregular surface.

4. The refiner plate of claim 1 wherein the refining surface includes an inner annular refining surface having a higher density of bars than a density of bars in the outer section of the refining surface.

5. The refiner plate of claim 1 wherein the refining bars have a curved longitudinal shape.

6. The refining plate of claim 1 wherein the protrusions of the irregular surface are most pronounced at an upper edge of the sidewall and is less pronounced proximate a substrate of the plate.

7. A refining plate for a mechanical refiner of lignocellulosic material comprising:

a refining surface on a substrate, wherein the refining surface is adapted to face a refining surface of an opposing refiner plate, and the refining surface including bars and grooves between the bars, wherein the bars have at least a radially outer section having a holdback angle of at least 30 degrees at the outer periphery of the bars, and the bars each include a sidewall having an irregular surface in the outer section, wherein the irregular surface include protrusions extending outwardly from the sidewall towards a sidewall on an adjacent bar, wherein the bars have a curved longitudinal shape which reverses in a direction of curvature with respect to a radial of the plate extending through the bar.

8. The refining plate of claim 7 wherein the holdback angle is at least 45 degrees.

9. The refining plate of claim 7 wherein the holdback angle is at least 60 degrees.

10. The refining plate of claim 7 wherein holdback angle is at least 70 degrees.

11. A refining plate for a mechanical refiner of lignocellulosic material comprising:

a refining surface on a substrate, wherein the refining surface is adapted to face a refining surface of an opposing refiner plate, and the refining surface including bars and grooves between the bars, wherein the bars have at least a radially outer section having a holdback angle of at least 30 degrees at the outer periphery of the bars, and the bars each include a sidewall having an irregular surface in the outer section, wherein the irregular surface include protrusions extending outwardly from the sidewall towards a sidewall on an adjacent bar, wherein the bars comprise an inner annular zone of straight bars having a holdback angle of no greater than 15 degrees, an outer annular zone of straight bars having a holdback angle of at least 45 degrees, and a middle annular zone having straight bars and a holdback angle of between 15 degrees and 45 degrees, wherein the middle annular zone is between the inner and outer annular zones.

12. A refining plate for a mechanical refiner of lignocellulosic materials, the plate having a refining surface comprising:

a plurality of bars upstanding from a substrate of the surface, wherein the bars extend outwardly towards an outer periphery of the plate, and an irregular leading or trailing sidewall on at least a portion of the bars, wherein the irregular surface include protrusions extending outwardly from the leading or trailing sidewall towards an opposite sidewall on an adjacent bar, wherein the bars comprise an inner annular zone of straight bars having a holdback angle of no greater than 15 degrees, an outer annular zone of straight bars having a holdback angle of at least 45 degrees, and a middle annular zone having straight bars and a holdback angle of between 15 degrees and 45 degrees, wherein the middle annular zone is between the inner and outer annular zones.

13. The refiner plate of claim 12 wherein the protrusions of the irregular surface form a pattern that is at least one of a zig-zag, sawtooth, series of bumps, sinusoid, sideways Z-pattern.

14. The refiner plate of claim 12 wherein the bars are curved along their length and the curve forms an exponential or involute arc.

15. The refiner plate of claim 12 wherein a radially outer portion of the bars have a holdback angle of at least 70 degrees.

16. The refiner plate of claim 12 wherein a radially outer portion of the bars have a holdback angle of at least 60 degrees.

17. The refiner plate of claim 12 wherein a radially outer portion of the bars have a holdback angle of at least 45 degrees.

18. The refiner plate of claim 12 wherein the plate is a rotor plate and is arranged in the refiner opposite to a stator plate or another rotor plate.

* * * * *